US010478038B1

(12) United States Patent
Gardner

(10) Patent No.: US 10,478,038 B1
(45) Date of Patent: Nov. 19, 2019

(54) POWER MOP

(71) Applicant: Robert A. Gardner, Chapel Hill, NC (US)

(72) Inventor: Robert A. Gardner, Chapel Hill, NC (US)

(73) Assignee: Wessol, LLC, Fort Mill, SC (US)

( * ) Notice: Subject to any disclaimer, the term of this patent is extended or adjusted under 35 U.S.C. 154(b) by 7 days.

(21) Appl. No.: 16/034,930

(22) Filed: Jul. 13, 2018

(51) Int. Cl.
*A47L 13/20* (2006.01)
*A47L 13/22* (2006.01)
*A47L 13/56* (2006.01)

(52) U.S. Cl.
CPC ..... *A47L 13/22* (2013.01); *A47L 13/20* (2013.01); *A47L 13/56* (2013.01)

(58) Field of Classification Search
CPC ..... A47L 13/20; A47L 13/22; A47L 13/56; A47L 13/26; A47L 13/42; A47L 11/00; A47L 11/02; A47L 11/03; A47L 11/04; B05C 17/00569; B05C 17/005
See application file for complete search history.

(56) References Cited

U.S. PATENT DOCUMENTS 4,971,471 A 11/1990 Sloan
6,394,683 B1 5/2002 Pao
6,550,998 B1 * 4/2003 Fernschild ..... A46B 11/063 401/270
6,854,912 B2 2/2005 Dyer et al.
7,794,165 B2 * 9/2010 Balz ..... A47L 13/30 401/137
9,504,366 B2 11/2016 Kasper et al.
9,574,764 B2 2/2017 Kowalski et al.
2003/0103795 A1 6/2003 Hollars et al.
2004/0146332 A1 7/2004 Fu
2006/0180187 A1 8/2006 Dallmann
2016/0243570 A1 8/2016 Lampe et al.

* cited by examiner

*Primary Examiner* — David J Walczak
(74) *Attorney, Agent, or Firm* — Shumaker, Loop & Kendrick, LLP

(57) ABSTRACT

A power mop is provided having a tank for holding a liquid positioned for gravity-induced flow of the liquid from a gravity feed conduit into a hand grip. Inside of the hand grip is a liquid inlet, a valve for controlling the flow of the liquid, a pump for providing flow pressure to the liquid, and a battery for powering the pump. Additionally, a switch is accessible external to the hand grip for powering the pump and switching the valve between open and closed liquid flow positions. A handle tube is connected to the hand grip. The handle tube contains a pressure feed conduit for receiving pressurized flow of the liquid from the hand grip. A nozzle is mounted on the handle tube to disperse the liquid onto the surface to be mopped. A mop head is attached to the end of the handle tube remote from the hand grip.

20 Claims, 3 Drawing Sheets

POWER MOP

TECHNICAL FIELD AND BACKGROUND OF THE INVENTION

This invention relates to a power mop used for applying a liquid to a surface for removing dirt, grime or other undesirable substances from a floor, or for waxing the surface of a floor. Specifically, this application discloses a power mop where the pump, switch, and battery are located in the hand grip of the mop.

Conventional mops require a bucket of liquid into which the mop head is dipped periodically. This method for cleaning or waxing a floor results in an uneven application of liquid, a problematic result, especially when waxing surfaces. Additionally, continuously repositioning and returning to the bucket for more liquid also increases inefficiency to the task. These conventional mops also have straight handles of wood, plastic or some other material that are not conducive to the ergonomics of a human hand.

More recently, mops with a tank located along the lower end of the mop handle have become popular and are widely available at most retail establishments that sell cleaning merchandise. The pumps for these household consumer products are either battery powered or manually operated for spraying the liquid onto the floor. While these mops are good for household use, they do not have the capability to store the large amount of liquid required for use in larger spaces such as in commercial applications. These more recent mops also do not allow for adjusting the spray of the liquid onto the surface for different applications like waxing, routine cleaning, or heavy-duty cleaning.

Other recent commercial applications include a separate sprayer and tank. These separate sprayer and tank devices add to the complexity of mopping by having to maintain control of multiple devices and having to control the liquid spray in conjunction with performing the task of mopping.

Another type of commercial mop has an attached tank with an offset control for the pump. An example of such mop is disclosed in U.S. Pat. No. 6,394,683. This offset control configuration is awkward to use and requires removing a hand from the mop interrupting the mopping process and adding inefficiency to the task. Additionally, the disclosed mop does not have an ergonomic handle and has no way to adjust the spray of liquid onto the surface for different types of applications.

SUMMARY OF THE INVENTION

It is therefore an object of the present invention to provide a power mop that has the pump, control switch, and battery housed in the hand grip to provide a compact, ergonomic and inexpensive product.

It is another object of the present invention to provide a power mop with an ergonomic hand grip.

It is another object of the present invention to provide a gravity-fed flow of liquid from the tank to the hand grip.

These and other objects and advantages of the present invention are achieved in the preferred embodiments set forth below by providing a power mop with a tank for holding a liquid positioned for gravity-induced flow of the liquid from a gravity feed conduit into a hand grip. Inside of the hand grip is a liquid inlet, a valve for controlling the flow of the liquid, a pump for providing flow pressure to the liquid, and a battery for powering the pump. Additionally, a switch is accessible external to the hand grip for powering the pump and switching the valve between open and closed liquid flow positions. A handle tube is connected to the hand grip. The handle tube contains a pressure feed conduit for receiving pressurized flow of the liquid from the hand grip. A nozzle is mounted on the handle tube to disperse the liquid onto the surface to be mopped. A mop head is attached to the end of the handle tube remote from the hand grip.

According to another embodiment, the hand grip has a left handle cover and a right handle cover that connect to define a chamber that contains the valve, the pump, the switch, and the battery.

According to another embodiment, the hand grip is angled in relation to the handle tube to be ergonomically correct.

According to another embodiment, the switch is configured as a finger trigger adapted to the ergonomics of a human hand for engagement by an index finger.

According to another embodiment, the finger trigger has a safety button protruding from the hand grip perpendicular to the finger trigger. The finger trigger maintains an unusable, locked state when the safety button is unengaged and a usable, unlocked state when the safety button is engaged by a thumb.

According to another embodiment, the battery is encased in a waterproof enclosure.

According to another embodiment, the nozzle is located on a nozzle component section located between the handle tube and the mop head.

According to another embodiment, the nozzle is adjustable to allow the nozzle to spray the liquid at varying patterns onto the surface.

According to another embodiment, the nozzle is interchangeable and housed in a nozzle receiver. The nozzle receiver is mounted on the handle tube and communicates with the pressure feed conduit to receive pressurized flow of the liquid.

According to another embodiment, the handle tube includes a quick change nozzle holder that stores a plurality of interchangeable nozzles.

According to another embodiment, the handle tube has a plurality of handle tube sections that connect to form the handle tube for a reduced footprint during shipping, storage, or manufacture.

According to another embodiment, the power mop includes a tank for holding a liquid positioned for gravity-induced flow of the liquid from a gravity feed conduit into a hand grip. The hand grip is formed by a left handle cover connected a right handle cover to define a chamber. Inside the hand grip is a liquid inlet, a valve for controlling the flow of the liquid, a pump for providing flow pressure to the liquid, and a battery for powering the pump. Additionally, a switch is accessible external to the hand grip for powering the pump and switching the valve between open and closed liquid flow positions. The switch is configured as a finger trigger adapted to the ergonomics of a human hand to be engaged by an index finger. A handle tube is connected at an angle relative to the hand grip to be ergonomically correct. The handle tube contains a pressure feed conduit for receiving pressurized flow of the liquid from the hand grip. A nozzle is mounted on the handle tube to disperse the liquid onto the surface to be mopped. A mop head is attached to the end of the handle tube remote from the hand grip.

According to another embodiment, the power mop includes a tank for holding a liquid positioned for gravity-induced flow of the liquid from a gravity feed conduit into a hand grip. Inside of the hand grip is a liquid inlet, a valve for controlling the flow of the liquid, a pump for providing flow pressure to the liquid, and a battery for powering the pump. Additionally, a switch is accessible external to the hand grip for powering the pump and switching the valve between open and closed liquid flow positions. A handle tube is connected to the hand grip. The handle tube contains a pressure feed conduit for receiving pressurized flow of the liquid from the hand grip. A nozzle receiver is mounted on the handle tube and houses an interchangeable quick-change nozzle to receive pressurized flow of the liquid from the pressure feed conduit and disperse the liquid onto the surface to be mopped. A quick change nozzle holder is positioned on the handle tube for storing a plurality of interchangeable nozzles. A mop head is attached on an end of the handle tube remote from the hand grip.

BRIEF DESCRIPTION OF THE DRAWING FIGURES

The present invention is best understood when the following detailed description of the invention is read with reference to the accompanying drawings, in which.

DETAILED DESCRIPTION OF THE PREFERRED EMBODIMENT

Figure 1:
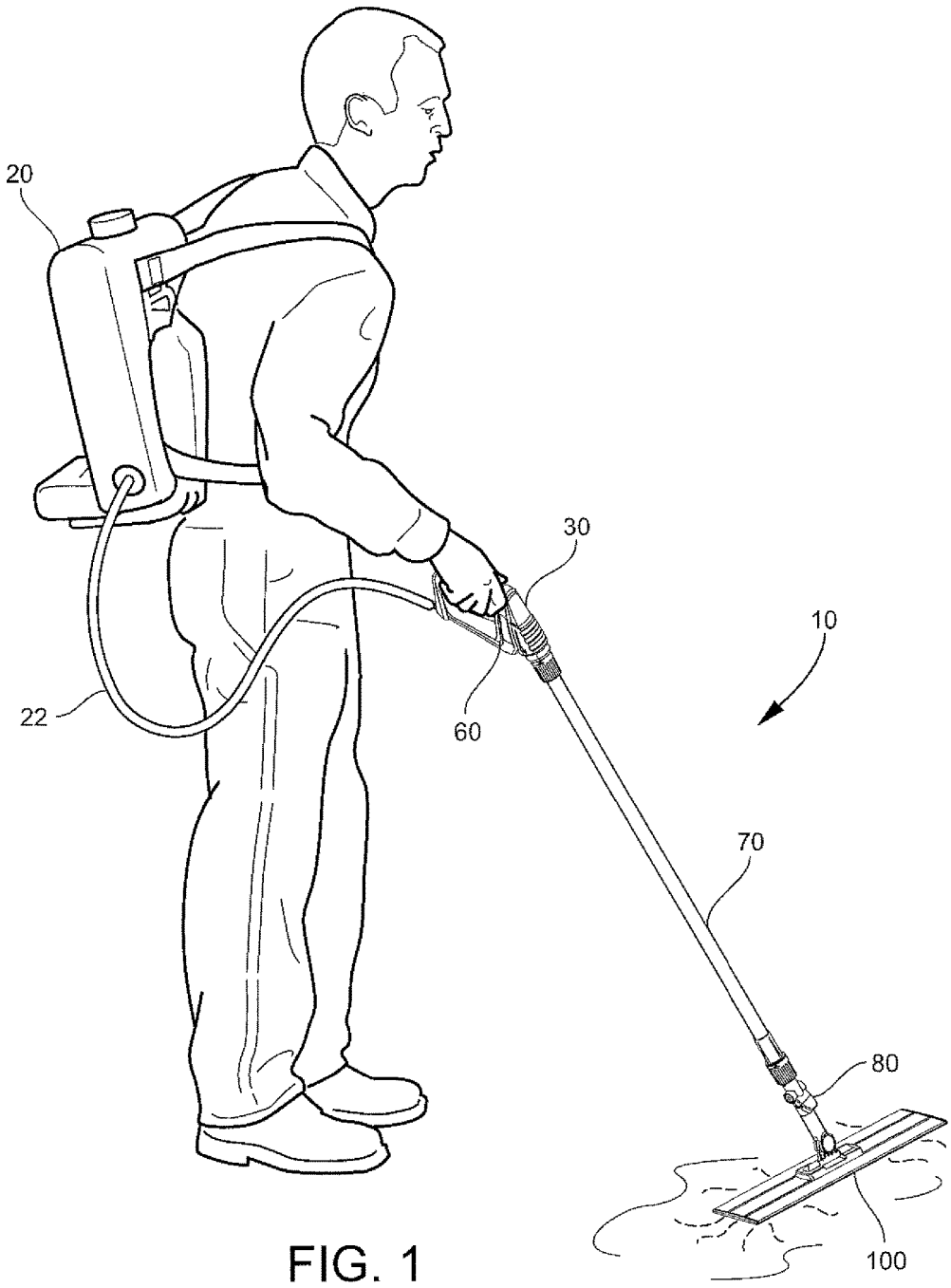
FIG. 1 is a side perspective environmental view of the power mop in use.

Referring now to the drawings, FIG. 1 shows a power mop 10 being used in the preferred embodiment. A tank 20 is at an elevated position with respect to a hand grip 30 and configured as a backpack. This elevated position enables the liquid to be gravity-fed into the hand grip 30 via a gravity feed conduit 22. The liquid then flows through a chamber 60 inside of the hand grip 30, through a handle tube 70, and is finally sprayed by a nozzle 80 onto the surface to be mopped. The hand grip 30 is designed such that it can be held in an ergonomically correct position while mopping and the handle tube 70 is angled in relation to the hand grip 30 to allow an ergonomical mopping motion. A mop head 100 is attached to the opposite end of the handle tube 70 as the hand grip 30 so that the surface can be mopped. This tank 20 configuration allows for cleaning or waxing of larger spaces due to a larger volume capacity that does not interfere with the ability to easily manipulate the mop 10 as needed.

Figure 2:
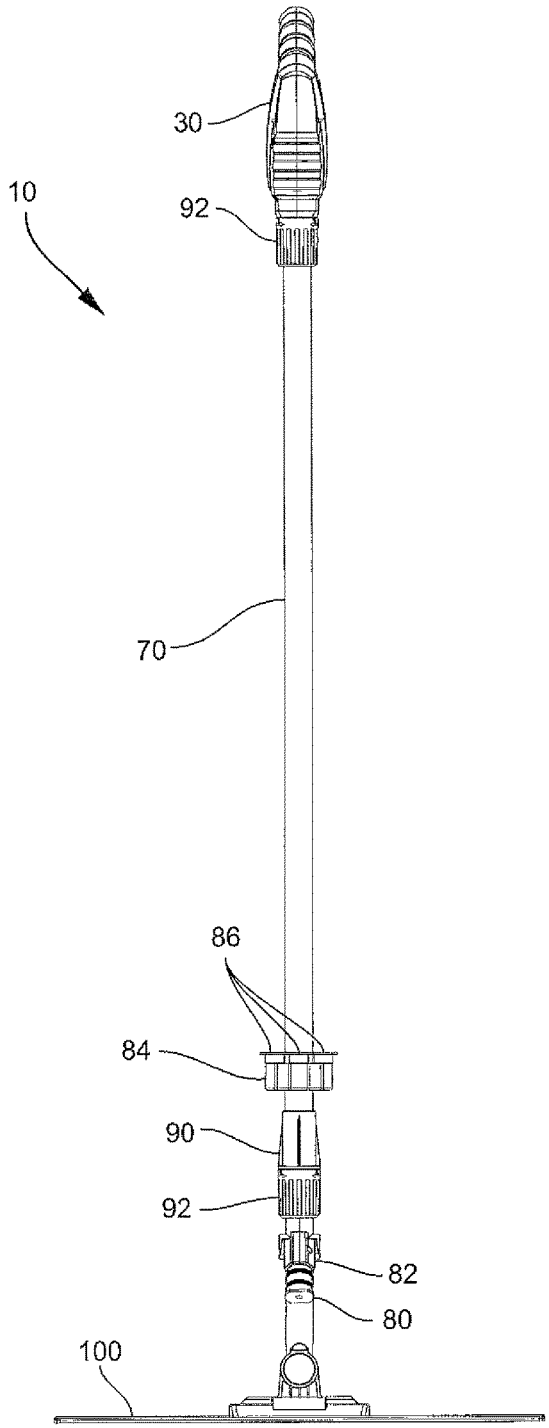
FIG. 2 is a front environmental view of the power mop without the tank.
Figure 3:
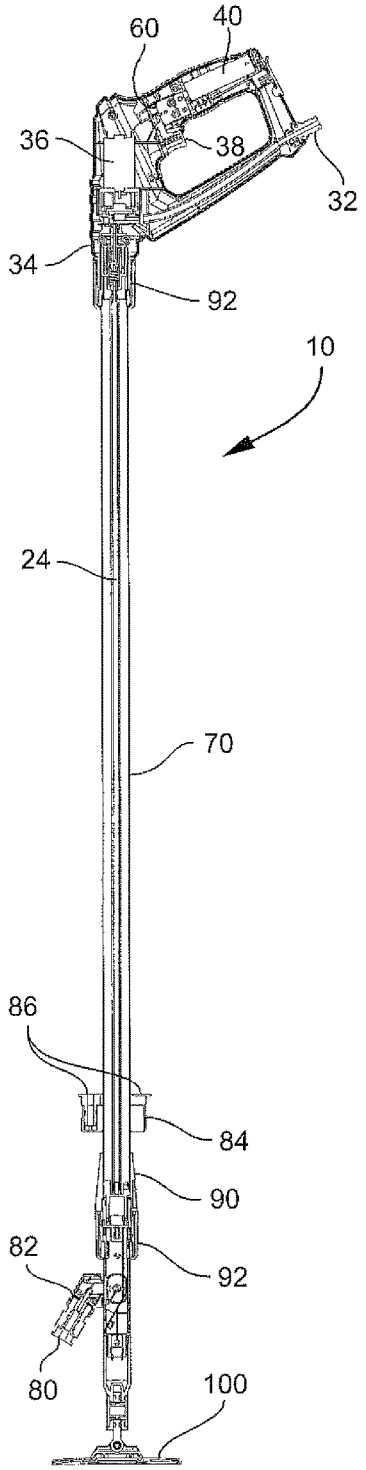
FIG. 3 is a side cross-sectional view of the power mop without the tank.
Figure 4:
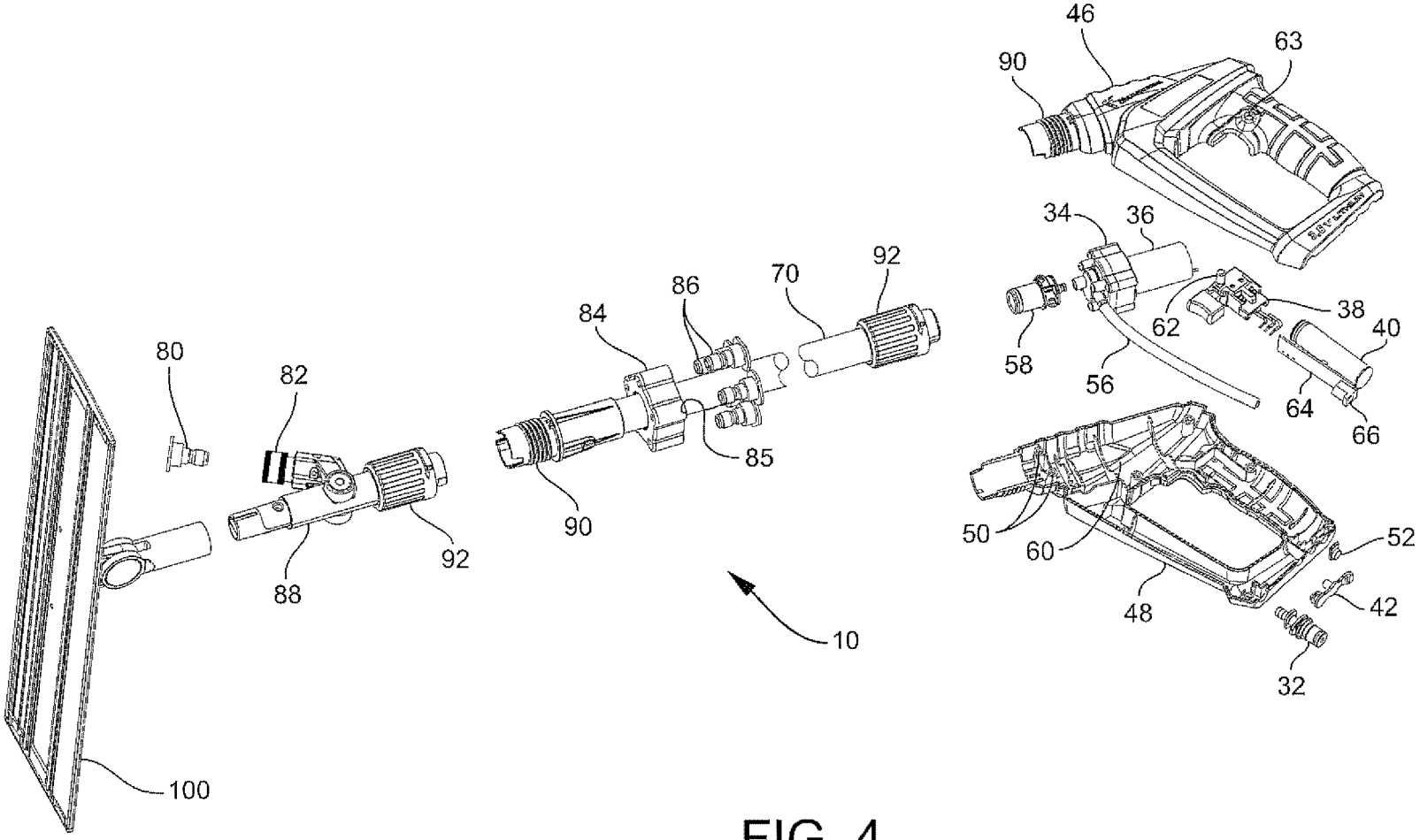
FIG. 4 is an exploded perspective view of the power mop.

Referring now to FIGS. 2, 3, and 4, the hand grip 30 is formed by a left handle cover 46 and a right handle cover 48 connected together to form the chamber 60. The two covers 46,48 are connected by screws at several screw hole locations (for example 50) to permit assembly and disassembly of the hand grip 30. The chamber 60 in the hand grip 30 contains a battery 40, a finger trigger switch 38, a motor 36 and a pump 34.

Liquid passes into the chamber 60 of the hand grip 30 from the gravity feed conduit 22 at a liquid inlet 32 and flows through a liquid inlet conduit 56 into the pump 34. The trigger 38 controls the power to the pump 34 and extends out of the hand grip 30 so that an index finger can engage the trigger 38. The trigger 38 has a safety button 62 perpendicular to the trigger 38 that protrudes out of the hand grip 30 though an opening for the safety button 63. When the safety 62 is unengaged the trigger is in an unusable, locked state. In order to engage the trigger 38 the safety 62 must be held down by the thumb of the hand holding the hand grip 62. This feature prevents unintentional spraying of liquid during mopping. Optionally, the trigger 38 may have a different type of safety feature such as a "lock-on" feature that enables the trigger 38 to be engaged when on, or may even have no safety feature included at all.

When the trigger 38 is not engaged, the circuit is open and the motor 36 and the pump 34 are not connected to the battery 40 and therefore inactive. Liquid is unable to flow beyond the inactive pump 34 because an internal valve (not shown) to the pump 34 maintains a closed flow position without power from the battery 40. However, when the trigger 38 is engaged, the battery 40 and the motor 36 are in a closed circuit enabling the battery 40 to power the motor 36 that operates the pump 34 which opens the internal valve (not shown) such that liquid can flow through the pump 34. The pump 34 provides a constant pressure to the liquid such that the spray maintains a similar pressure irrespective of the quantity of liquid in the tank 20.

In the preferred embodiment the battery 40 is a 3.6 volt lithium battery and has a waterproof encasing. Attached to the battery 40 is a circuit board 64 with a charging port 66 and an LED indicator (not shown). Both of these circuit board 64 features are accessible as openings on the hand grip with a waterproof plug 42 covering the access opening for the charging port 66 and a LED indicator cover 52 covering the opening for the LED indicator (not shown) while still allowing visibility.

When the pump 34 is active, the valve (not shown) is open and fluid pressure is applied to the liquid. This pressurized liquid then flows into a water outlet connector 58. The water outlet connector 58 serves to guide the pressurized liquid out of the chamber 60 of the hand grip 30 and into a pressure feed conduit 24. The pressure feed conduit 24 is located inside of the handle tube 70. The pressure feed conduit 24 terminates at the nozzle 80 allowing for liquid to be sprayed in front of the mop head 100 onto the surface.

The nozzle 80 is removable and located inside of a nozzle receiver 82. The nozzle receiver 82 is adjustable to allow for altering the angle of spray in relation to the floor. A plurality of interchangeable nozzles 86 are stored in a quick change nozzle holder 84 located on the handle tube 70. The nozzle holder 84 wraps around the circumference of the handle tube 70 and contains several holsters (for example 85) for holding the interchangeable nozzles 86. The interchangeable nozzles 86 allow for varying rates of spray, spray direction, and spray shape onto the surface to be mopped. Optionally, one or more of these interchangeable nozzles 86 stored in the nozzle holder 84 can be identical and therefore serve as spares in the event of loss or wear and tear.

In the embodiment of this application the handle tube 70 has a separate nozzle component section 88 where the nozzle receiver 82 is located. Both the nozzle component section 88 and the hand grip 30 are attached to the handle tube 70 by a female threaded connector 92 and a male threaded connector 90. The female threaded connector 92 is twisted until it is firmly mated to the male threaded connector 90. For the hand grip 30 and handle tube 70 connection, the female connector 92 is located on the handle tube 70 and the male connector 90 is located on the hand grip 30. For the nozzle component section 88 and handle tube 70 connection, the female connector 92 is located on the nozzle component section 88 and the male connector 90 is located on the handle tube 70. Optionally, the handle tube 70 can be formed by several connected sections. This can be advantageous for shipping, storage and manufacture.

A power mop according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

10 Power Mop
20 Tank
22 Gravity Feed Conduit
24 Pressure Feed Conduit
30 Hand Grip
32 Liquid Inlet
34 Pump
36 Motor
38 Finger Trigger Switch
40 Battery
42 Waterproof Plug
46 Left Handle Cover
48 Right Handle Cover
50 Screw Holes
52 LED Indicator Cover
56 Liquid Inlet Conduit
58 Water Outlet Connector
60 Chamber
62 Safety Button
63 Opening for Safety Button
64 Circuit Board
66 Charging Port
70 Handle Tube
80 Nozzle
82 Nozzle Receiver
84 Quick Change Nozzle Holder
85 Holsters
86 Interchangeable Nozzles
88 Nozzle Component Section
90 Male threaded connector
92 Female threaded connector
100 Mop Head

I claim:

1. A power mop, comprising:

(a) a tank for holding a liquid and adapted to be positioned for gravity-induced flow of the liquid, and including a gravity feed conduit for transporting the liquid from the tank;

(b) a hand grip containing a liquid inlet communicating with the gravity feed conduit for receiving the gravity-induced flow of the liquid from the tank, a valve for controlling the flow of the liquid from the tank to a pump located downstream from the valve for providing flow pressure to the liquid, a battery for powering the pump, and a switch accessible external to the hand grip for powering the pump and switching the valve between open and closed liquid flow positions;

(c) a handle tube connected to the hand grip containing a pressure feed conduit for receiving pressurized flow of the liquid from the hand grip;

(d) a nozzle mounted on the handle tube and adapted to disperse the liquid onto a surface to be mopped; and (e) a mop head attached on an end of the handle tube remote from the hand grip.

2. The power mop of claim 1, wherein the hand grip comprises a left handle cover and a right handle cover that connect to define a chamber containing the valve, the pump, the switch, and the battery.

3. The power mop of claim 1, wherein the handle tube is angled in relation to the hand grip to be ergonomically correct.

4. The power mop of claim 1, wherein the switch is configured as a finger trigger adapted to the ergonomics of a human hand for engagement by an index finger.

5. The power mop of claim 4, wherein the finger trigger includes a safety button protruding from the hand grip perpendicular to the finger trigger and the finger trigger maintains an unusable, locked state when the safety button is unengaged and a usable, unlocked state when the safety button is engaged by a thumb.

6. The power mop of claim 1, wherein the battery is encased in a waterproof enclosure.

7. The power mop of claim 1, wherein the nozzle is located on a nozzle component section located between the handle tube and the mop head.

8. The power mop of claim 1, wherein the nozzle is adjustable to allow the nozzle to spray the liquid at varying patterns onto the surface.

9. The power mop of claim 1, wherein the nozzle is interchangeable and housed in a nozzle receiver mounted on the handle tube for communicating with the pressure feed conduit to receive pressurized flow of the liquid.

10. The power mop of claim 9, wherein the handle tube includes a quick change nozzle holder for storing a plurality of interchangeable nozzles.

11. The power mop of claim 1, wherein the handle tube comprises a plurality of handle tube sections connected to form the handle tube to provide a reduced footprint during shipping, storage, or manufacture.

12. A power mop, comprising:

(a) a tank for holding a liquid and adapted to be positioned for gravity-induced flow of the liquid, and including a gravity feed conduit for transporting the liquid from the tank;

(b) a hand grip created by a left handle cover connected a right handle cover to define a chamber containing a liquid inlet communicating with the gravity feed conduit for receiving the gravity-induced flow of the liquid from the tank, a valve for controlling the flow of the liquid from the tank to a pump located downstream from the valve for providing flow pressure to the liquid, a battery for powering the pump, and a switch accessible external to the hand grip and configured as a finger trigger adapted to the ergonomics of a human hand for engagement by an index finger for powering the pump and switching the valve between open and closed liquid flow positions;

(c) a handle tube connected to the hand grip angled in relation to the hand grip to be ergonomically correct containing a pressure feed conduit for receiving pressurized flow of the liquid from the hand grip;

(d) a nozzle mounted on the handle tube adapted to disperse the liquid onto a surface to be mopped; and (e) a mop head attached on an end of the handle tube remote from the hand grip.

13. The power mop of claim 12, wherein the nozzle is adjustable to allow for the nozzle to spray the liquid at varying patterns onto the surface.

14. The power mop of claim 12, wherein the nozzle is interchangeable and housed in a nozzle receiver mounted on the handle tube for communicating with the pressure feed conduit to receive pressurized flow of the liquid.

15. The power mop of claim 14, wherein the handle tube includes a quick change nozzle holder for storing a plurality of interchangeable nozzles.

16. The power mop of claim 12, wherein the finger trigger includes a safety button protruding from the hand grip perpendicular to the finger trigger and the finger trigger maintains an unusable, locked state when the safety button is unengaged and a usable, unlocked state when the safety button is engaged by a thumb.

17. A power mop, comprising:

(a) a tank for holding a liquid and adapted to be positioned for gravity-induced flow of the liquid, and including a gravity feed conduit for transporting the liquid from the tank;

(b) a hand grip containing a liquid inlet communicating with the gravity feed conduit for receiving the gravity-induced flow of the liquid from the tank, a valve for controlling the flow of the liquid from the tank to a pump located downstream from the valve for providing flow pressure to the liquid, a battery for powering the pump, and a switch accessible external to the hand grip for powering the pump and switching the valve between open and closed liquid flow positions;

(c) a handle tube connected to the hand grip containing a pressure feed conduit for receiving pressurized flow of the liquid from the hand grip;

(d) a nozzle receiver mounted on the handle tube, and housing an interchangeable quick-change nozzle to receive pressurized flow of the liquid from the pressure feed conduit and disperse the liquid onto a surface to be mopped;

(e) a quick change nozzle holder positioned on the handle tube for storing a plurality of interchangeable nozzles; and (f) a mop head attached on an end of the handle tube remote from the hand grip.

18. The power mop of claim 17, wherein the hand grip comprises a left handle cover and a right handle cover that connect to define a chamber containing the valve, the pump, the switch, and the battery.

19. The power mop of claim 17, wherein the handle tube is angled in relation to the hand grip to be ergonomically correct.

20. The power mop of claim 17, wherein the switch is configured as a finger trigger adapted to the ergonomics of a human hand for engagement by an index finger.

* * * * *